US005495272A

United States Patent [19]

Yamaguchi

[11] Patent Number: 5,495,272

[45] Date of Patent: Feb. 27, 1996

[54] INK JET HEAD AND CLEANING DEVICE AND METHOD FOR THE HEAD

[75] Inventor: Shuichi Yamaguchi, Nagano, Japan

[73] Assignee: Seiko Epson Corporation, Tokyo, Japan

[21] Appl. No.: 31,963

[22] Filed: Mar. 16, 1993

[30] Foreign Application Priority Data

Mar. 18, 1992 [JP] Japan ..... 4-062394
Feb. 25, 1993 [JP] Japan ..... 5-037055

[51] Int. Cl.[6] ..... B41J 2/165

[52] U.S. Cl. ..... 347/28; 347/93

[58] Field of Search ..... 346/1.1, 140; 347/28, 347/27, 93

[56] References Cited

U.S. PATENT DOCUMENTS

| | | | |
|---|---|---|---|
| 4,251,824 | 2/1981 | Hara | 347/57 X |
| 4,296,418 | 10/1981 | Yamazaki | 347/28 |
| 4,380,770 | 4/1983 | Maruyama | 347/89 |
| 4,546,363 | 10/1985 | Iwagami | 347/28 |
| 4,814,794 | 3/1989 | Sato | 347/28 |
| 4,849,769 | 7/1989 | Dressler | 347/27 |
| 4,947,187 | 8/1990 | Iwagami | 347/28 |
| 5,113,205 | 5/1992 | Sato | 347/92 |

FOREIGN PATENT DOCUMENTS

| | | | |
|---|---|---|---|
| 3917568 | 11/1989 | Germany | B41J 3/04 |
| 54-160242 | 12/1979 | Japan | B41J 3/04 |
| 63-5947 | 1/1988 | Japan | B41J 3/04 |

OTHER PUBLICATIONS

Patent Abstracts of Japan, vol. 6, No. 89, May 27, 1982 & JP–A–57–027–757.

IBM Technical Disclosure Bulletin, vol. 19, No. 10, Mar. 1977, pp. 3703–3704.

Patent Abstracts of Japan, vol. 10, No. 353, Nov. 28, 1986 & JP–A–61–152–457.

Patent Abstracts of Japan, vol. 12, No. 315, Aug. 26, 1988 & JP–A–63–087–241.

Patent Abstracts of Japan, vol. 7, No. 124, May 82, 1983 & JP–A–58–042–467.

VNesci, A; Flow Reversing Valve for Ink Jet Head, IBM TDB, V18, N12, May 1976, pp. 4138–4139.

*Primary Examiner*—Joseph W. Hartary

*Attorney, Agent, or Firm*—Sughrue, Mion, Zinn, Macpeak & Seas

[57] ABSTRACT

A cleaning solution supplying device is set in such a manner that it is communicated with a cleaning solution supply section through a cleaning solution supply pipe, and covers the end face of an ink jet head, and a cleaning solution sucking device, which is communicated with a used solution receiving section through a suction pump, is connected to a cleaning solution discharge outlet provided between the ink jet head and the ink supply passageway, so that the cleaning solution is intermittently sucked into the ink jet head through the orifices or ink filter of the latter and discharged therefrom, thereby to positively remove foreign matters from the ink jet head.

11 Claims, 6 Drawing Sheets

INK JET HEAD AND CLEANING DEVICE AND METHOD FOR THE HEAD

BACKGROUND OF THE INVENTION 1. (Field of the Invention)

This invention relates to an ink jet head, and a cleaning device and a cleaning method employed in the manufacture of the ink jet head.

2. (Description of the Related Art)

In recording data on a recording sheet with an ink jet head, ink is jetted from the minute orifices of the ink jet head so as to stick on the recording sheet. The orifices are extremely small in diameter, several tens of micro-meters (μm). This is a main cause for the trouble that dust or foreign matters are caught in the orifices, thus obstructing an ink jetting operation. If that trouble occurs, the manufacture of the ink jet head is lowered in yield.

In order to eliminate this difficulty, for instance Japanese Patent Application (OPI) No. Sho 63-5947 (the term "OPI" as used herein means an "unexamined published application") has disclosed a method in which a cleaning passageway is formed in the wall of an ink passageway near the orifices in such a manner that it is communicated with the outside of the ink jet head body, and a cleaning solution is allowed to flow in the cleaning passageway to remove dust and foreign matters from the orifices.

On the other hand, in order to increase the repetitive response frequency of the ink jet head or to decrease the drive voltage, an on-demand type ink jet head is popularly employed which has a flow path structure as shown in FIG. 16. That is, as shown in FIG. 16, ink supply passageways 8 and ink supply passageway throttles 7 smaller in diameter than the former 8 are provided on the side of a common ink chamber 15 communicated with pressure chambers 10, to suppress the flow of ink to the ink chamber 15. It is true that this structure has improved the response characteristic and the drive voltage of the ink jet head; however, the latter is still disadvantageous in the following point: The ink supply passageway throttles 7 of the ink supply passageways 8 are several tens of micro-meters in diameter similarly as in the case of the orifices. Therefore, dust or foreign matters coming in the ink chamber 15 during manufacture, being moved by the ink, block the ink supply passageway throttles 7, so that the ink is not smoothly jetted from the orifices 11. The present inventors have conducted research on the ink jet head, and found that it is possible to remove foreign matters from the pressure chambers 10, but it is not possible to remove foreign matters from the ink supply passageway throttles 7. In addition, the inventors have investigated where the foreign matters are caught in the ink jet head, and found that 99% of the foreign matters are caught at the ink supply passageway throttles 7, and the remaining at the orifices 11. This means that it is essential to prevent foreign matters from being caught at the ink supply passageway throttles 7.

On the other hand, a method of washing away foreign matters from the pressure chamber has been proposed in the art; however, it is not concrete. That is, the foreign matters cannot be completely removed merely by running a cleaning solution, and it is necessary to improve the cleaning solution running method.

If a cleaning solution for cleaning mechanical parts is employed for removal of the foreign matters, the remaining solution may clog up the ink jet head when dried, or it reacts with the ink, to form depositions which may damage the components of the ink jet head.

SUMMARY OF THE INVENTION

Accordingly, an object of this invention is to eliminate the above-described difficulties accompanying a conventional ink jet head, ink jet head cleaning device, and ink jet head cleaning method.

More specifically, an object of the invention is to provide an ink jet head from which foreign matters can be completely removed, and a cleaning device and cleaning method for completely removing foreign matters from the ink jet head.

The foregoing object and other objects of the invention have been achieved by the provision of the following means:

The first means is an ink jet head comprising a common ink chamber communicated with an ink supply section, and a plurality of ink jetting paths which are communicated with the common ink chamber and include pressure generating means, in which, according to the invention, a cleaning solution discharge outlet is formed at a part of an ink passageway extended between the ink supply section and the common ink chamber, the cleaning solution discharge outlet disposed in opposition to a surface of the filter which faces away from the ink supply section and being sealingly closed.

The second means is an ink jet head cleaning device which, according to the invention, comprises: cleaning solution supplying means which is communicated with a cleaning solution supplying section through a cleaning solution supply pipe, and covers the surface of an ink jet head; and cleaning solution sucking means which is communicated with a used solution receiving section through a suction pump, and is connected to a cleaning solution discharge outlet between the ink jet head and an ink supply passageway.

The third means is an ink jet head cleaning method in which, according to the invention, a cleaning solution is supplied into an ink jet head through orifices thereof, while being sucked and discharged through a cleaning solution discharge outlet provided between the ink jet head and an ink passageway.

The nature, principle, and utility of the invention will be more clearly understood from the following detailed description of the invention when read in conjunction with the accompanying drawings.

DETAILED DESCRIPTION OF THE PREFERRED EMBODIMENTS

Preferred embodiments of this invention will be described with reference to the accompanying drawings.

Figure 1:
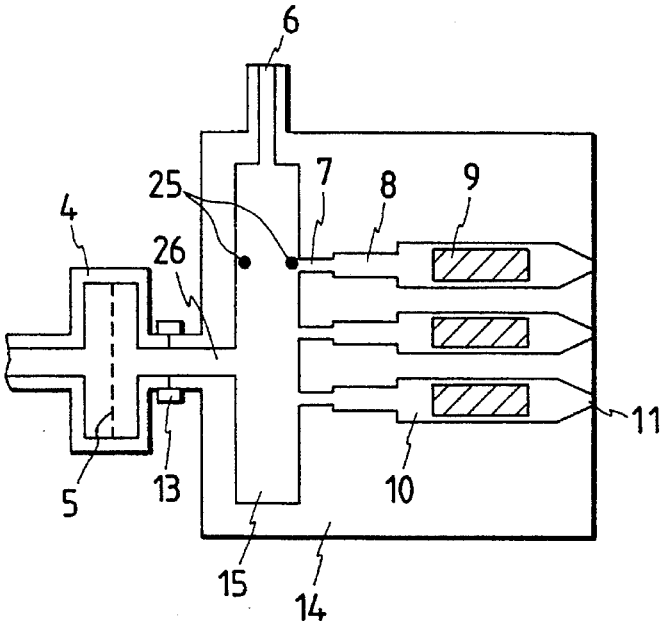
FIG. 1 is a sectional view showing a first example of an ink jet head according to this invention.

A first example of an ink jet head according to the invention is as shown in FIG. 1.

An ink passageway substrate 14 includes: ink jetting orifices 11; pressure chambers 10 communicated with the orifices 11; ink supply passageways 8 and ink supply passageway throttles 7 through which ink is supplied from a common ink chamber 15 to the pressure chambers 10; and pressure generating means, namely, piezo-electric elements 9 in the pressure chambers 10. Each of the piezo-electric elements 9 is to produce pressure to jet ink. In a main ink passageway through which the ink is supplied into the common ink chamber 15, an ink filter 5, which is accommodated in a filter fixing unit 4 connected to the ink passageway substrate 14 through a passageway connector 13, is provided for prevention of the entrance of dust or foreign matter into the ink. A cleaning solution discharge outlet 6 is provided for the common ink chamber 15 which is located between the filter 5 and the ink supply passageway throttles 7.

The main purpose of the provision of the cleaning solution discharge outlet 6 is to remove foreign matters 25 such as dust which are introduced during manufacture and are larger than the diameter, approximately 100 μm, of the ink supply passageway throttles 7. If the outlet 6 is not provided, and therefore the cleaning solution is discharged through an ink supply inlet (not shown), then foreign matters come in through the inlet when the cleaning device is connected to or disconnected from the ink jet head. This difficulty has been eliminated by the provision of the cleaning solution discharge outlet 6. The ink jet head with the cleaning solution discharge outlet 6 can be cleaned with high efficiency, because the cleaning solution may be discharged through the cleaning solution discharge outlet 6 while being sucked in through the orifices 11 and the ink supply inlet. Furthermore, the cleaning operation may be carried out with the filter fixing unit 4 connected to the ink supply inlet. In this case, both the filter fixing unit 4 and the ink jet head can be washed simultaneously without the entrance of foreign matters into the ink passageways.

Figure 2:
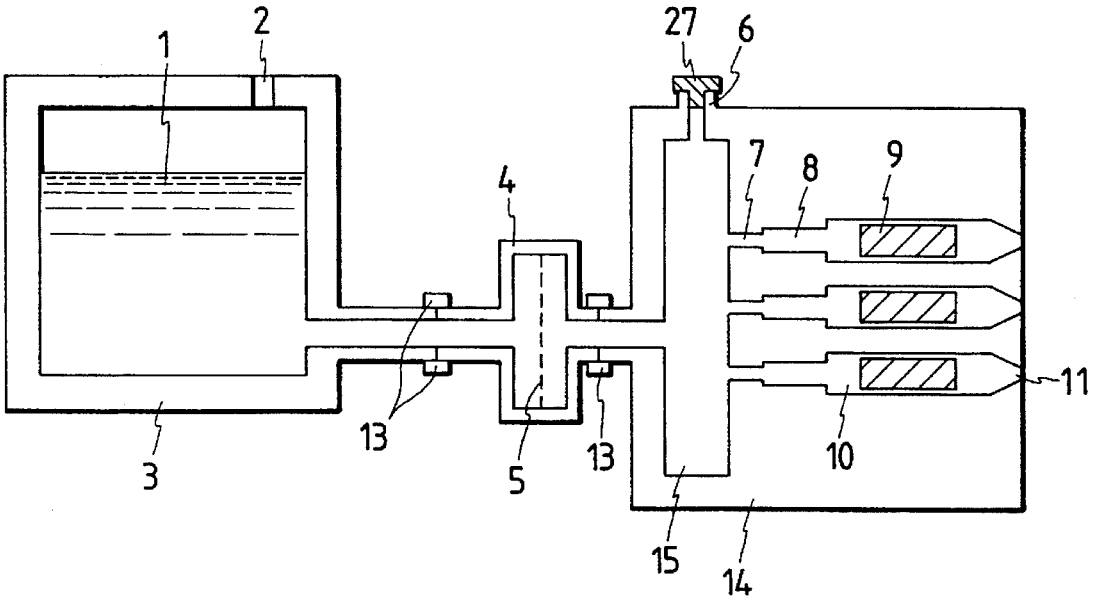
FIG. 2 is a sectional view showing the ink jet head which is connected to an ink tank.

The ink jet head shown in FIG. 1 is connected to an ink tank 3 as shown in FIG. 2.

The ink tank 3 has a ventilation hole 2. The ink 1 in the ink tank 3 is allowed to flow through the ink filter 5 in the filter fixing unit 4 into the common ink chamber 15 formed in the ink passageway substrate 14. The ink 1 further flows from the common ink chamber 15 into the pressure chambers 10 through the ink supply passageway throttles 7 and the ink supply passageways 8 which are communicated with the pressure chambers 10, respectively. In the pressure chambers 10, the piezo-electric elements 9 are driven to produce pressure waves to jet ink droplets from the orifices 11. After the ink jet head has been cleaned, the cleaning solution discharge outlet 6 is closed with a sealing member 27, to prevent the leakage of ink or the entrance of foreign matters.

The ink filter 5 is to prevent the entrance of foreign matters mixed in the ink 1 in the ink tank into the ink passageway substrate 14. In general, the ink filter 5 is at most 50 μm in effective minimum diameter.

Figure 3:
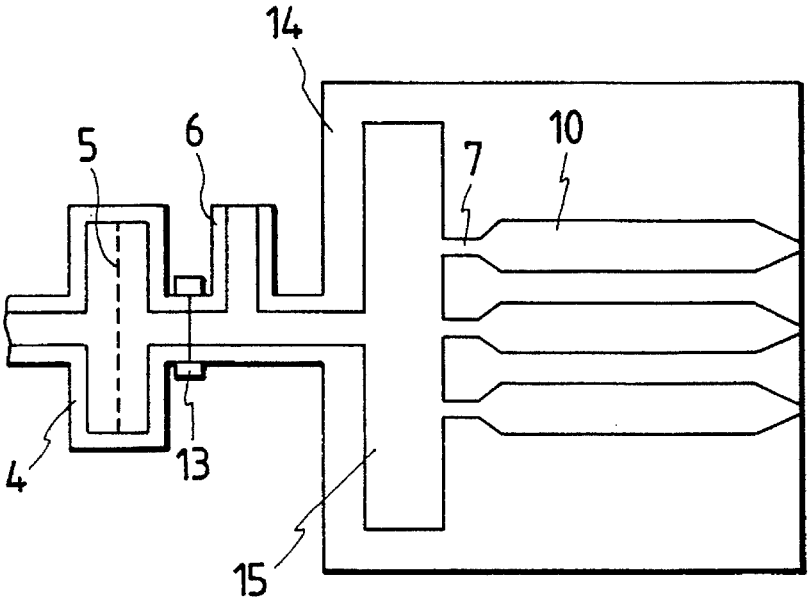
FIG. 3 is a sectional view showing a second example of the ink jet head according to the invention.

A second example of the ink jet head according to the invention is as shown in FIG. 3.

In the ink jet head, its cleaning solution discharge outlet 6 is provided in the main ink passageway at a position which is between the filter fixing unit 4 and the common ink chamber 15 and closer to the ink passageway substrate 14. The main ink passageway may be formed as follows: The ink passageway substrate 14 is made of resin, and a second substrate (not shown) is bonded to the ink passageway substrate 14 thus formed. In this case, the main ink passageway is located away from the body of the ink passageway substrate 14, which eliminates the difficulty that the resultant molding sinks or the metal mold is not sufficiently filled with resin. That is, the junction surfaces of the ink passageway substrate and the second substrate are improved in flatness, and therefore those substrates can be bonded together with ease. In the ink jet head shown in FIG. 3, the cleaning solution discharge outlet 6 is integral with the ink jet head; however, the former may be provided separately from the latter. In the ink jet head shown in FIG. 3, the pressure chambers are connected directly to the ink supply passageway throttles; however, in this case, too, the cleaning solution discharge outlet should be provided upstream of the ink supply passageway throttles.

Figure 4:
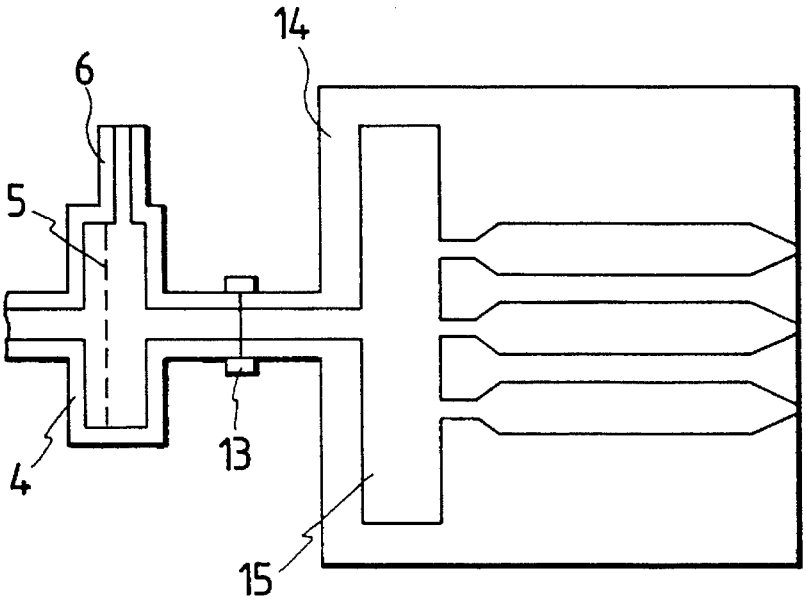
FIG. 4 is a sectional view showing a third example of the ink jet head according to the invention.

A third example of the ink jet head according to the invention is as shown in FIG. 4.

In the ink jet head, its cleaning solution discharge outlet 6 is communicated with the main ink passageway through the ink filter 5 of the filter fixing unit 4. With this structure, the inside of the filter fixing unit 4 can be more positively washed.

Now, an ink jet head cleaning device according to the invention will be described in detail.

Figure 5:
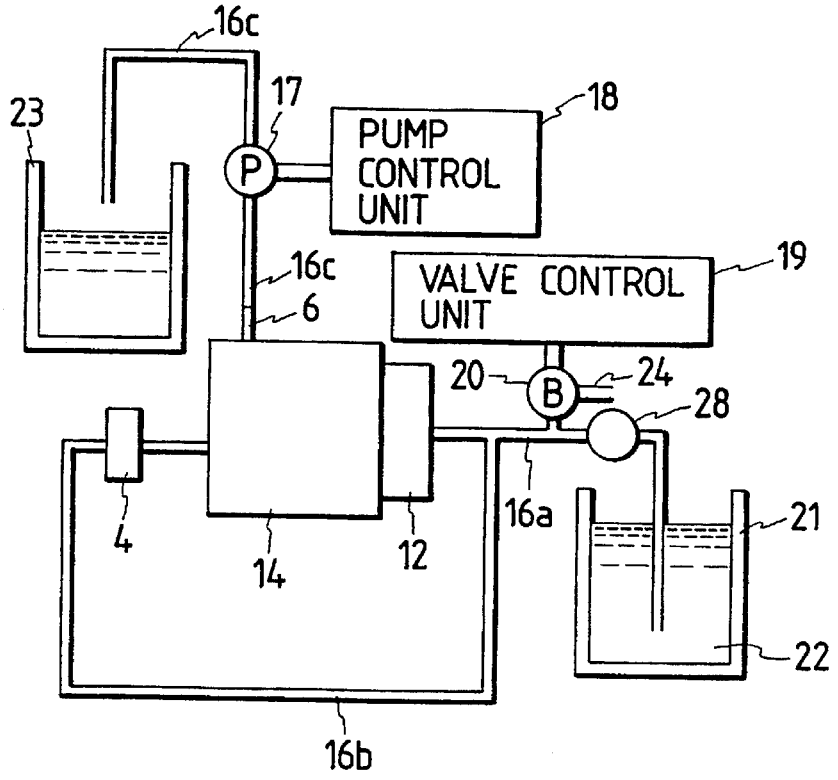
FIG. 5 is an explanatory diagram showing a first example of an ink jet head cleaning device according to the invention.

FIG. 5 shows a first example of the ink jet head cleaning device according to the invention.

The ink jet head cleaning device comprises a cleaning solution supplying device, and a cleaning solution sucking device. The cleaning solution supplying device includes: a cap 12 for sealingly covering the orifices 11 of the ink jet head; a tube **16*a* for supplying a cleaning solution 22 from a cleaning solution container 21 to the cap 12; and a tube 16*b* connected between the tube 16*a* and the upstream connecting end of the filter-fixing unit 4 of the ink jet head. The cleaning solution sucking device includes: a tube 16*c* connected to the cleaning solution discharge outlet 6 of the ink jet head, and to a pump 17 having a pump control unit 18; and a used solution receiving container 23**.

In the cleaning solution supplying device, the tube **16*a* is connected to a control valve 20 which controls the communication of the tube 16*a* with an air communication pipe 24 which is communicated with the outside air. The operation of the control valve 20 is controlled by a valve control unit 19. A cleaning solution filter 28, whose diameter is smaller than the minimum effective diameter of the orifices, is provided between the cleaning solution container 21 and the branch point on the tube 16***a* from which the control valve 20 branches. The cleaning solution filter 28 is to prevent the orifices from being clogged up by foreign matters in the cleaning solution during a cleaning solution sucking operation.

In the device shown in FIG. 5, the positions of the control valve 20 and the cleaning solution filter 28 may be swapped with each other.

Now, an ink jet head cleaning method according to the invention will be described.

The pump 17 is operated to suck the cleaning solution 22 into the common ink chamber 15 through the orifices and the filter fixing unit 4, so that the foreign matters 25 in the ink jet head are caused to flow with the cleaning solution thus sucked. As a result, the foreign matters 25 are discharged out of the ink jet head through the cleaning solution discharge outlet 6. In this connection, the inventor performed experiments, and found that it was rather difficult to remove the foreign matters merely by continuing the cleaning solution sucking operation. On the other hand, in the method of the invention, during the cleaning solution sucking operation, the valve control unit 19 is operated to repeatedly open and close the control valve 20 to frequently interrupt the flow of the cleaning solution, thereby to give dynamic pressures to the foreign matters; i.e., to vibrate the latter. Therefore, the method of the invention can remove even foreign matters which have been stuck to the ink jet head. The same effect can be obtained by operating the pump control unit 18 so that the pump is repeatedly turned on and off. The two control units 18 and 19 may be operated in combination for more effect. Furthermore, the same effect may be obtained by the following method: Before the above-described cleaning operation is carried out, the ink or cleaning solution is allowed to flow from the side of the filter fixing unit 4 towards the side of the orifices 11 to collect the foreign matters at the ends of the ink supply passageway throttles, and the cleaning solution is caused to flow from the orifices to the cleaning solution discharge outlet in the above-described manner.

Figure 6:
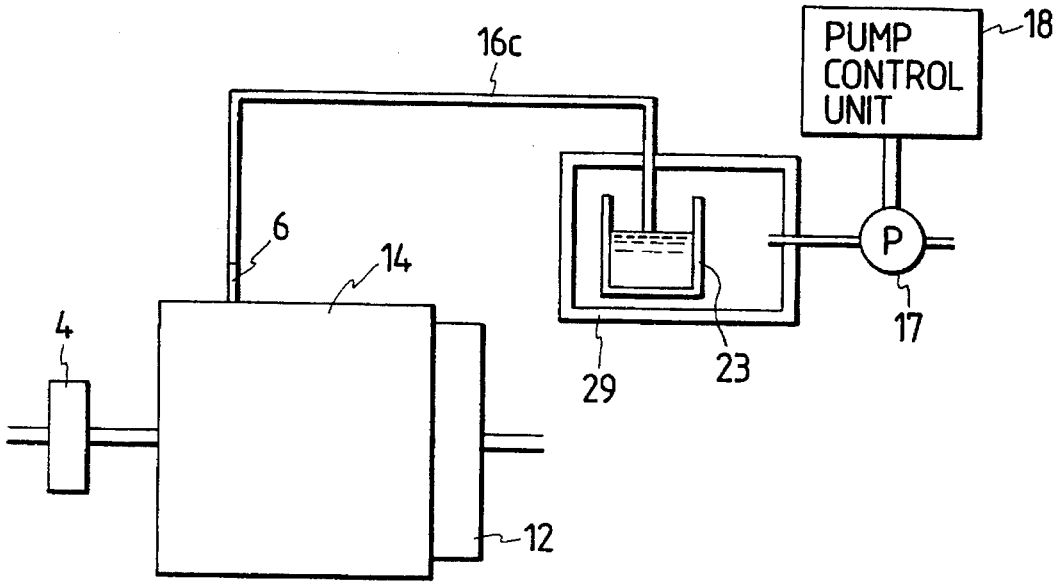
FIG. 6 is an explanatory diagram showing a second example of the ink jet head cleaning device according to the invention.

A second example of the ink jet head cleaning device according to the invention is as shown in FIG. 6, in which parts corresponding functionally to those which have been described with reference to FIG. 5 are therefore designated by the same reference numerals or characters. In the device, the cleaning solution discharge outlet 6 is not directly connected to the pump 17. That is, a vacuum container 29 is provided between the cleaning solution discharge outlet 6 and the pump 17. A used solution receiving container 23 is set in the vacuum container, and a tube 16*c* connected to the cleaning solution discharge outlet 6 is extended to the used solution receiving container 23. The pump 17 is operated to reduce the pressure in the vacuum container 29. The pump may be other than a liquid pump, because it is used to suck the air instead of the cleaning solution. The pump will never be clogged up unless its components are damaged by the cleaning solution.

Figure 7:
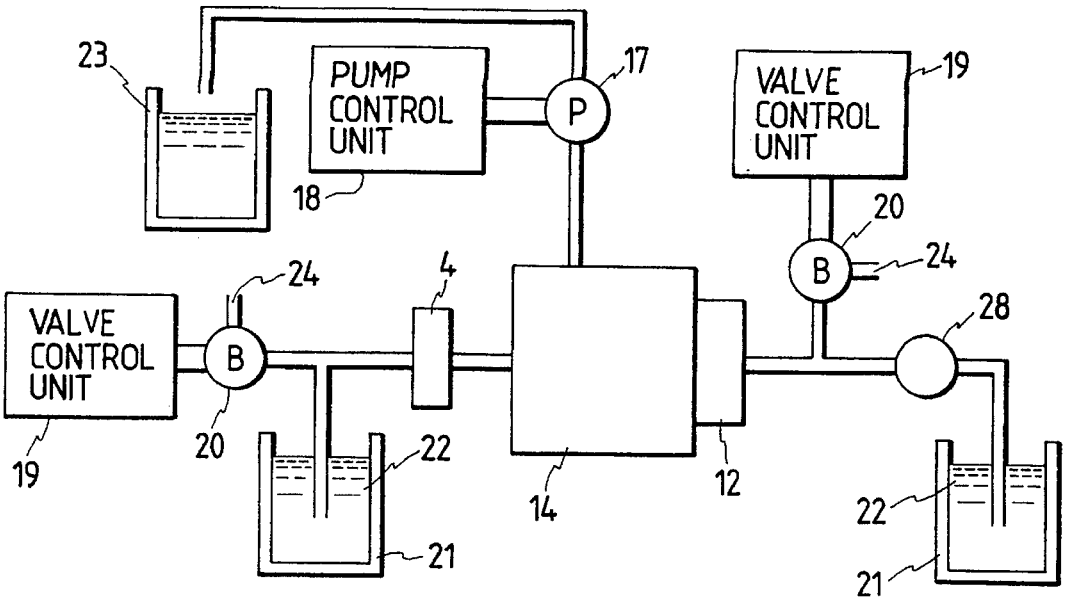
FIG. 7 is an explanatory diagram showing a third example of the ink jet head cleaning device according to the invention.

A third example of the ink jet head cleaning device according to the invention is as shown in FIG. 7, in which parts corresponding functionally to those which have been described with reference to FIG. 5 are therefore designated by the same reference numerals or characters.

In the above-described first example of the cleaning device, the cleaning solution flow-in line on the side of the orifices 11 and that on the side of the filter fixing unit 4 are connected to each other, and to the control valve 20 and the cleaning solution container 21. On the other hand, in the third example of the cleaning device, two control valves 20 and two cleaning solution containers 21 are provided; that is, the cleaning solution flow-in line on the side of the orifices 11 is connected to one of the control valves 20 and one of the cleaning solution containers 21, and the cleaning solution flow-in line on the side of the filter fixing unit 4 is connected to the other control valve 20 and the other cleaning solution container 21. In the cleaning device thus arranged, the cleaning solutions in the cleaning solution containers may be sucked in alternately or simultaneously. On the side of the filter fixing unit 4,instead of the cleaning solution container filled with cleaning solution, an ink tank filled with ink may be connected.

Figure 8:
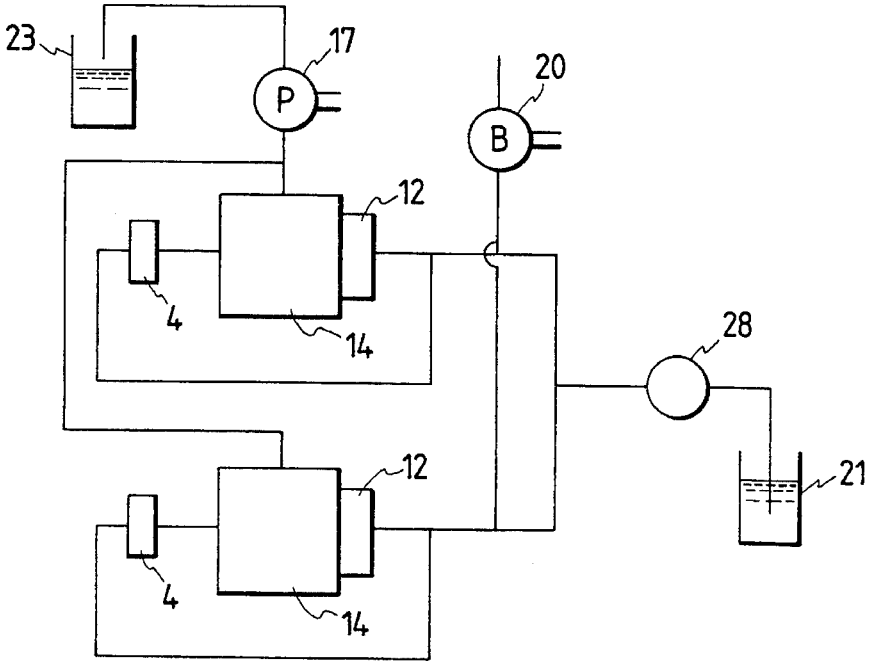
FIG. 8 is an explanatory diagram showing a fourth example of the ink jet head cleaning device according to the invention.

A fourth example of the ink jet head cleaning device according to the invention is as shown in FIG. 8, in which parts corresponding functionally to those which have been described with reference to FIG. 5 are therefore designated by the same reference numerals or characters.

In manufacture of ink jet heads on a large scale, it is necessary to clean a number of ink jet heads simultaneously with high efficiency. In the fourth example, in order to clean two ink jet heads at the same time, two ink jet head cleaning units similar to the cleaning device shown in FIG. 5 (the first example) are connected in such a manner that one pump and one control valve are used in common. In the case of FIG. 8, only two ink jet heads are cleaned; however, the invention is not limited thereto or thereby. That is, it goes without saying that more than two ink jet heads can be cleaned by arranging them in parallel as shown in FIG. 8.

Figure 9:
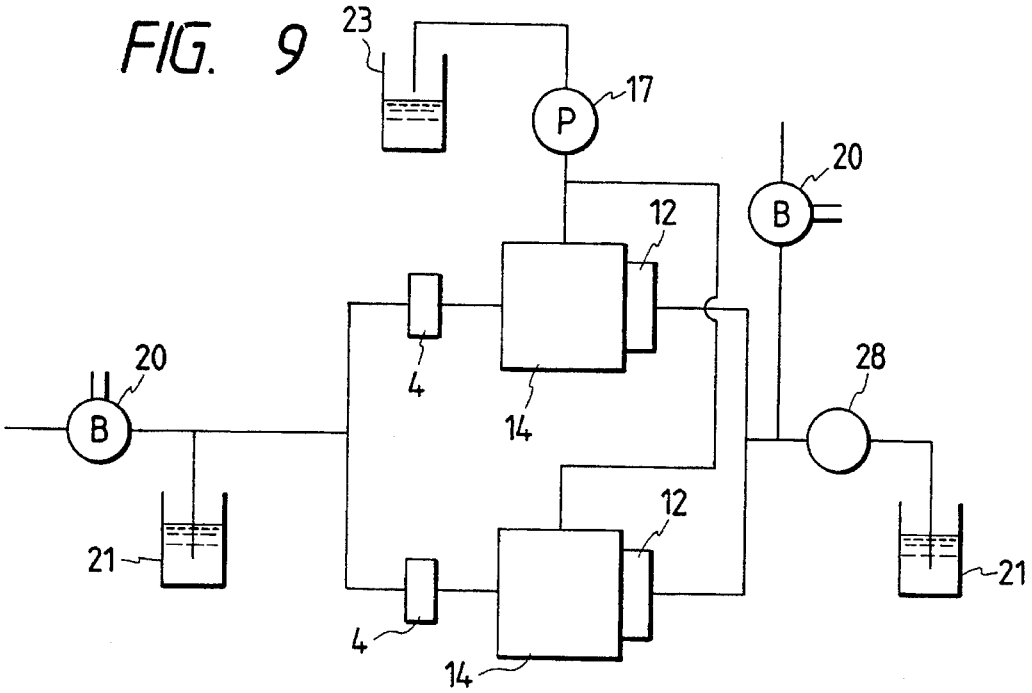
FIG. 9 is an explanatory diagram showing a fifth example of the ink jet head cleaning device according to the invention.

A fifth example of the ink jet head cleaning device of the invention is as shown in FIG. 9.

As was described above, in manufacture of ink jet head on a large scale, it is necessary to clean a number of ink jet heads simultaneously with high efficiency. For this purpose, in the fifth example, too, two ink jet heads cleaning units similar to the cleaning device shown in FIG. 7 (the third example) are connected in such a manner that one pump and one control valve are used in common, to clean two ink jet heads in a parallel mode. In this case, too, more than two ink jet heads can be cleaned by arranging them in parallel.

Figure 10:
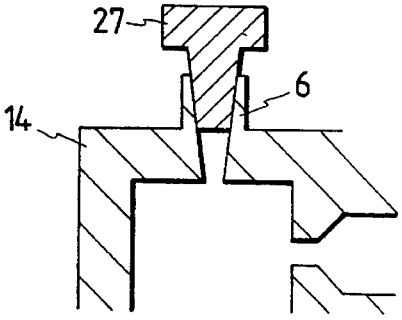
FIGS. 10 through 13 are sectional views showing examples of a sealing member for a cleaning solution discharge outlet according to the invention.

FIG. 10 shows a first example of a method of sealingly closing the cleaning solution discharge outlet 6. The cleaning solution discharge outlet 6 has a inner cylindrical surface tapered inwardly, into which a plug 27 is fitted. The plug 27 is made of an elastic material such as resin or rubber. In order to positively close the cleaning solution discharge outlet 6, it is preferable that the cleaning solution discharge outlet 6 is circular in cross section. In order to seal the discharge outlet 6 with high reliability, the plug should be coated with adhesive before fitted into the discharge outlet 6.

Figure 11:
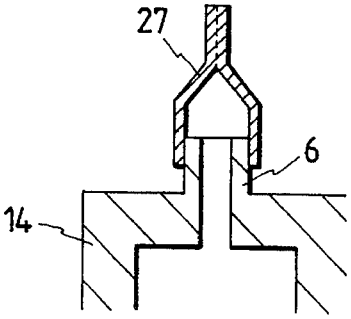

FIG. 11 shows a second example of the method of sealingly closing the cleaning solution discharge outlet 6. In the method, the plug 27 is formed as follows: A tube circular in section, which is made of resin or rubber, is flattened at one end. The plug 27 is fixedly put on the cleaning solution discharge outlet 6. In this case, an annular step may be formed on the outer cylindrical surface of the cleaning solution discharge outlet 6, so that the plug 27 is fixedly mounted on the cleaning solution discharge outlet 6 along the annular step with a metal fitting set from outside.

Figure 12:
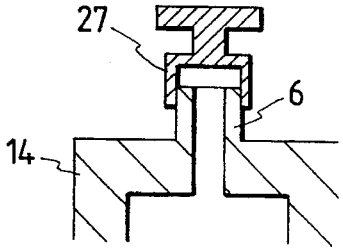

FIG. 12 shows a third example of the method of sealingly closing the cleaning solution discharge outlet 6. In the method, the plug 27 is formed as shown in FIG. 12 by using an elastic material such as rubber. The plug 27 thus formed is put on the cleaning solution discharge outlet 6.

Figure 13:
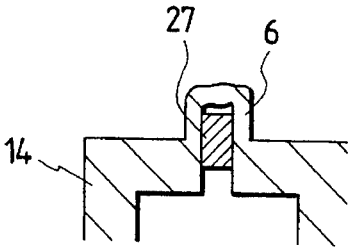

FIG. 13 shows a fourth example of the method of sealingly closing the cleaning solution discharge outlet 6. A plug 27 is buried in the cleaning solution discharge outlet 6, and thereafter the cleaning solution discharge outlet 6 is molten by heat so that the plug may not come off.

In addition, the cleaning solution discharge outlet 6 may be sealed as follows: The cleaning solution discharge outlet 6 is filled with ultra-violet ray effect resin, and the latter is solidified by application of ultra-violet rays. Alternatively, the cleaning solution discharge outlet 6 may be sealingly closed with a screw.

Figure 14:
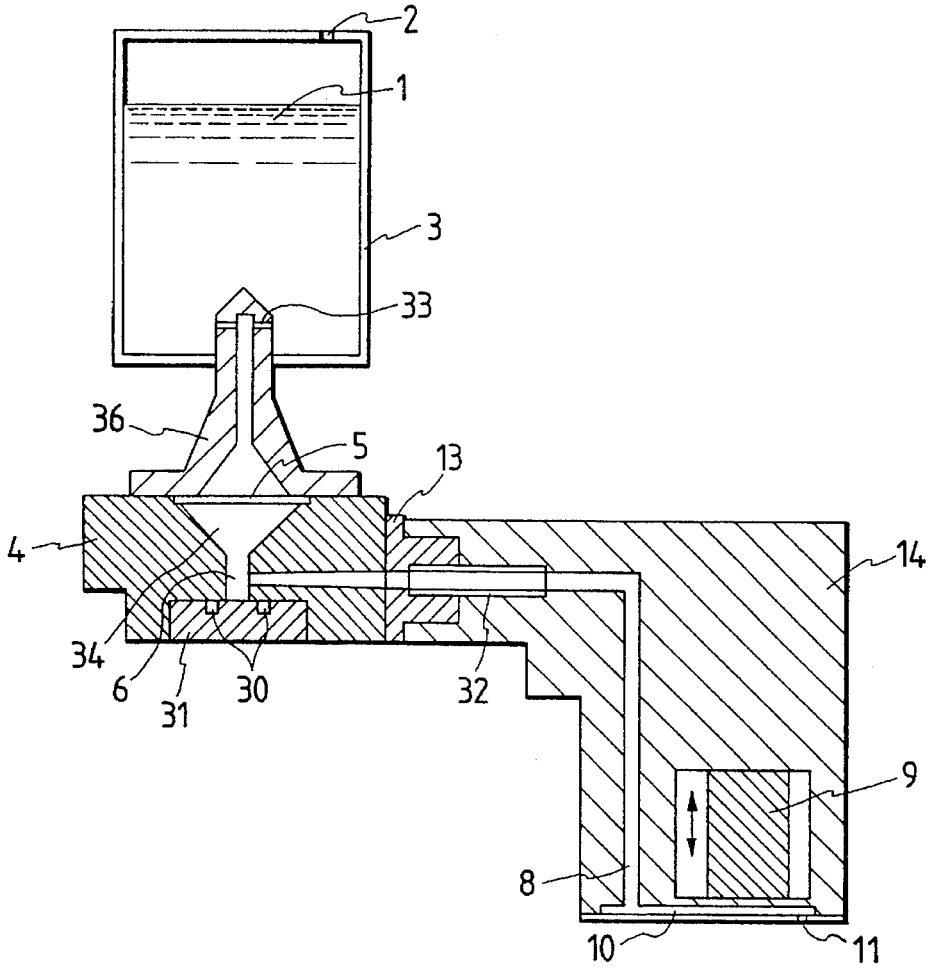
FIG. 14 is a sectional view showing an ink jet recording device according to the invention.

FIG. 14 is a sectional view of an ink jet recording device, for a description of another example of the method of sealing closing the cleaning solution discharge outlet 6. As shown in FIG. 14, a needle 36 having a needle hole 33 is inserted into an ink tank 3 filled with ink 1, so that the ink is allowed to flow into a filter fixing unit 4 in which a filter 5 is fixedly set; that is, the ink is led into a filter chamber 34 in the filter fixing unit 4. The ink thus led is run through a pipe 32 into a pressure chamber 10, where it is jetted as ink droplets from an orifice 11 by the pressure which a piezo-electric element 9 provides vibrating in the directions of the arrow. The filter chamber 34 has a cleaning solution discharge outlet 6 at one end. The cleaning solution discharge outlet 6 is disposed in opposition to a surface of the filter which faces away from ink tank 3 and has an axis that is perpendicular to the filter and is sealingly closed with a sealing plug 31. In this case, adhesive or solvent may be employed to more positively close the discharge outlet 6, or the sealing plug 31 may be welded to the cleaning solution discharge outlet 6 by an ultra-sonic welding method.

Figure 15:
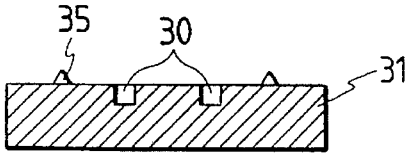
FIG. 15 is a sectional view of a sealing plug in the device shown in FIG. 14.
Figure 16:
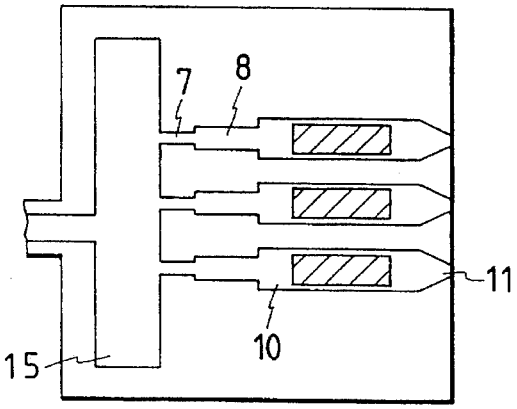
FIG. 16 PRIOR ART
FIG. 16 is a sectional view of a conventional ink jet head.

The sealing plug 31, as shown in FIG. 15, has an annular groove 30 which surrounds the cleaning solution discharge outlet 6 when the sealing plug 31 is engaged with the latter 6. The annular groove 30 is to trap the flow of adhesive or solvent or deposits formed during the ultra-sonic welding operation. In addition, the sealing effect may be further improved by fitting an O-ring in the annular groove 30. The sealing plug 31 has a director 35 like a ring, which also surrounds the cleaning solution discharge outlet 6 when the sealing plug is engaged with the latter 6. The director 35 is molten during the ultra-sonic welding operation. More specifically, the welding energy is concentrated at the director 35 to melt the latter 35. It is recommended to employ the ultra-sonic welding method to weld the sealing plug to the cleaning solution discharge outlet 6, because the ultra-sonic welding operation scarcely forms foreign matters which may be caught in the ink passageway and is accomplished in a short time, and is able to sufficiently seal the cleaning solution discharge outlet.

The filter fixing unit 4 or the cleaning solution discharge outlet sealing plug 31 may be formed by using polyacetal, polystyrene, or polysulfone which is resistive against ink, and excellent in adhesive characteristic and in ultra-sonic welding characteristic.

Now, the cleaning solution employed in the invention will be described.

The cleaning solution should meet the following requirements:

(1) It is able to positively remove foreign matters from the surface of the ink passageway.

(2) While flowing in the ink passageway, it will not deteriorate the material of the ink passageway, (3) When it is left in the ink passageway, it will not clog up the latter.

(4) It will not adversely affect the surface of the ink passageway or orifices which have been made water-repellent or hydrophilic.

In cleaning the ink jet head, the cleaning solution should flow at a certain flow rate or a certain speed. For this purpose, the cleaning solution should have a viscosity of 100 cP or less.

With the above-described requirements taken into consideration, the inventor performed experiments and found the following facts: A cleaning solution containing at least one of the components of the ink is able to achieve a satisfactory cleaning operation without damaging the material of the ink passageway. An alkaline solution at least 10 in pH index shows a high cleaning effect. Examples of the alkaline solution are a potassium hydroxide solution, or a sodium hydroxide solution, and a triethanol amine solution, which are 0.5% or more in weight percent density. In addition, a cleaning solution formed by adding a surface active agent to at least one of the components of the ink shows a high cleaning effect. The surface active agent may be a nonionic surface active agent, cation surface active agent, anion surface active agent, or amphoteric surface active agent. Of those surface active agents, "Surfenol (phonetic) 465, TG, 82 (manufactured by "Nisshin Kagaku")" shows a high cleaning effect, and scarcely foams during cleaning.

In the above-described embodiments of the invention, the ink jet head includes the piezo-electric elements 9 in the pressure chambers 10; however, it should be noted that the invention is not limited thereto or thereby. That is, the technical concept of the invention may be equally applied to an ink jet head in which, for instance, instead of the piezo-electric elements 9, thermal energy generating elements are employed.

As was described above, the ink jet head according to the invention is so designed that foreign matters caught at the ink supply passageway throttles can be removed during manufacture. Hence, the ink jet head of the invention can be manufactured with high yield. Furthermore, it is unnecessary that the ink jet heat is extremely high in cleanliness before cleaned. With the cleaning device of the invention, a number of ink jet heads can be cleaned at the same time, and the difficulty is prevented that foreign matters contained in the cleaning solution are caught at the orifices, thus clogging up the latter.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. An ink jet head system comprising:

an ink jet head comprising:

orifices;

ink supply means for supplying ink;

a filter chamber communicated with said ink supply means;

a filter member lying in a plane and being disposed between said common ink chamber and said ink supply means;

a plurality of ink jet passageways communicated with said filter chamber and including pressure generating means therein, said ink jet passageways also including a narrowed throttle portion;

a cleaning solution discharge outlet formed between said filter member and said throttle portions, said discharge outlet being disposed proximate a connecting portion which connects a flow passage extending from the filter chamber and said ink jet passageways, said discharge outlet being disposed in opposition to a surface of said filter which faces away from said ink supply means and said discharge outlet defining a longitudinal axis which is substantially perpendicular to said plane; and means for sealingly closing said cleaning solution discharge outlet.

2. An ink jet head system as claimed in claim 1, wherein:

said cleaning solution discharge outlet is formed in said filter chamber proximate said throttle portions.

3. An ink jet head system as claimed in claim 1, further comprising:

means for supplying a cleaning solution to said ink jet head, said supplying means including a reservoir for said cleaning solution, a cap which is brought in close contact with said orifices of said ink jet head for supplying said cleaning solution from the end face of said ink jet head, and a supply pipe for cleaning solution through which the cleaning solution is supplied from said reservoir to said cap; and means for sucking a used cleaning solution from said ink jet head, said sucking means including a discharge pipe detachably connect to said cleaning solution discharge outlet, a suction pump, and a tank communicated with said discharge pipe through said suction pump for receiving said used solution.

4. A system as claimed in claim 3, further comprising a pipe line which branchs from said supply pipe, and is connected to said ink jet head upstream of said discharge outlet for supplying said cleaning solution from a rear side of said ink jet head.

5. A system as claimed in claim 3, further comprising a control valve provided in said supply pipe, and having one end thereof being connected to a pipe line which is communicated with the outside air.

6. A method of cleaning an ink jet head, said ink jet head comprising orifices;

ink supply means for supplying ink having plural components;

a filter chamber communicated with said ink supply means, a filter member lying in a plane and being disposed between said filter chamber and said ink supply means, a plurality of ink jet passageways communicated with said filter chamber and including pressure generating means therein, said ink jet passageways also including a narrowed throttle portion, a cleaning solution discharge outlet formed between said filter member and said throttle portions, said discharge outlet being disposed proximate a connecting portion which connects a flow passage extending from the filter chamber and said ink jet passageway, said discharge outlet being disposed in opposition to a surface of said filter which faces away from said ink supply means and said discharge outlet defining a longitudinal axis which is substantially perpendicular to said plane, and means for sealingly closing said cleaning solution discharge outlet, said method comprising the steps of:

supplying a cleaning solution into said ink jet head through said orifices; and simultaneously sucking and discharging said cleaning solution through said cleaning solution discharge outlet.

7. A method as claimed in claim 6, in which said in which said simultaneous sucking and discharging is intermittent.

8. A method as claimed in claim 6, in which said supplying step comprises alternately supplying said cleaning solution and air into said ink jet head through said orifices.

9. A method as claimed in claim 6, in which said cleaning solution contains at least one of the components of said ink.

10. A method as claimed in claim 6, in which said cleaning solution comprises an alkaline solution at least 10 in pH index.

11. A method as claimed in claim 6, in which a cleaning solution contains a surface active agent.

* * * * *